US007089905B2

(12) United States Patent
Tsutsumi et al.

(10) Patent No.: US 7,089,905 B2
(45) Date of Patent: Aug. 15, 2006

(54) LUBRICATING STRUCTURE FOR AN ENGINE

(75) Inventors: Koichi Tsutsumi, Saitama (JP); Hidetoshi Takamatsu, Saitama (JP); Ryuichi Abe, Saitama (JP); Hiroyuki Sugiura, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 132 days.

(21) Appl. No.: 10/889,465

(22) Filed: Jul. 12, 2004

(65) Prior Publication Data

US 2005/0039718 A1 Feb. 24, 2005

(30) Foreign Application Priority Data

Aug. 20, 2003 (JP) ..... 2003-296297

(51) Int. Cl.
*F01M 1/00* (2006.01)

(52) U.S. Cl. ..... 123/196 R; 123/196 S; 123/198 C; 123/198 E

(58) Field of Classification Search ..... 123/196 R, 123/196 S, 198 C, 198 E
See application file for complete search history.

(56) References Cited

U.S. PATENT DOCUMENTS 6,116,205 A * 9/2000 Troxler et al. ..... 123/196 R
6,823,829 B1 * 11/2004 Kawamoto et al. ..... 123/196 R

FOREIGN PATENT DOCUMENTS

JP 2002122290 A 4/2002

* cited by examiner

*Primary Examiner*—Tony M. Argenbright
*Assistant Examiner*—Katrina Harris
(74) *Attorney, Agent, or Firm*—Carrier, Blackman & Associates, P.C.; Joseph P. Carrier; William D. Blackman

(57) ABSTRACT

A lubricating structure for an engine includes a crankcase for supporting a crankshaft formed from a pair of case halves coupled to each other along a mating plane extending along a plane perpendicular to an axial line of the crankshaft. An oil reservoir in a lower portion of the crankcase extends across the mating plane. A pump chamber of an oil pump is formed between the two case halves across the mating plane. Lubricant is drawn from the oil reservoir into the oil pump using a structure which can achieve reduction of the number of parts and improve the ease of assembly. The structure includes a path groove, which forms an oil suction path for interconnecting the oil pump and the oil reservoir, formed in at least one of the two case halves.

13 Claims, 7 Drawing Sheets

LUBRICATING STRUCTURE FOR AN ENGINE

CROSS-REFERENCE TO RELATED APPLICATIONS

The present invention claims priority under 35 USC 119 based on Japanese patent application No. 2003-296297, filed Aug. 20, 2003.

1. Field of the Invention

This invention relates to a lubricating structure for an engine wherein a crankcase for supporting a crankshaft for rotation thereon is formed from a pair of case halves coupled to each other along a mating plane extending along a plane perpendicular to an axial line of the crankshaft and an oil reservoir is formed at a lower portion of the crankcase below the crankshaft in such a manner as to extend across the mating plane while a pump chamber of an oil pump for sucking oil from the oil reservoir is formed between the two case halves across the mating plane.

2. Description of the Background Art

A lubricating structure for an engine wherein an oil reservoir is formed between lower portions of a pair of case halves coupled to each other along a mating plane to form a crankcase such that it extends across the mating plane and a pump chamber of an oil pump is formed between the two case halves across the mating plane is already known, for example, from Japanese Patent Laid-Open No. 2002-122290 and so forth.

In the conventional lubricating structure for an engine described above, however, oil in the oil reservoir is introduced into the oil pump through an oil pipe provided exclusively for such purpose. Therefore, not only do the number of parts increase, but the conventional lubricating structure for an engine is not easy to assemble since it is necessary to attach the oil pump to the crankcase.

The present invention has been made in view of such a situation as described above, and it is an object of the present invention to provide a lubricating structure for an engine wherein oil in an oil reservoir can be introduced into an oil pump using a structure which can achieve a reduction of the number of parts and an improvement in the ease of assembly.

SUMMARY OF THE INVENTION

In order to attain the object described above, according to a first aspect of the present invention, a lubricating structure for an engine is provided. The engine crankcase for supporting a crankshaft for rotation thereon is formed from a pair of case halves coupled to each other along a mating plane extending along a plane perpendicular to an axial line of the crankshaft. An oil reservoir is formed at a lower portion of the crankcase below the crankshaft in such a manner as to extend across the mating plane. A pump chamber of an oil pump for sucking oil from the oil reservoir is formed between the two case halves across the mating plane, and a path groove, which forms an oil suction path for interconnecting the oil pump and the oil reservoir between the two case halves which form the mating plane therebetween, is provided in at least one of the two case halves.

Meanwhile, according to a second aspect of the present invention, in addition to the first aspect as set forth above, when the oil pump is mounted on a vehicle and disposed forwardly of the crankshaft, the oil suction path is disposed around the crankshaft and communicates with the oil reservoir at a lower portion of a front wall of the oil reservoir.

Further, according to a third aspect of the present invention, in addition to either of the first and second aspects, an engine hanger boss is provided on the crankcase below the crankshaft, and the oil suction path is disposed so as to pass between the crankshaft and the engine hanger boss.

According to the first aspect of the present invention, the oil suction path for introducing the oil in the oil reservoir into the oil pump is formed by coupling the pair of case halves to each other along the mating plane to form the crankcase. Therefore, when the lubricating structure for an engine is compared with a conventional lubricating structure for an engine which uses an oil pipe, increased width of the engine caused by leftward and rightward projection of the oil path can be prevented and a bank angle is assured. Further, the number of parts can be reduced and improvement in the ease of assembly can be achieved.

According to the present invention, the oil suction path is disposed in the proximity of the crankshaft. Consequently, the minimum road clearance of the crankcase can be set comparatively high while the volume of the oil reservoir can be set comparatively large.

Further, according to the second aspect of the present invention, since the internal pressure of the oil suction path is low, the seal width of the oil suction path on the mating plane can be set small. Accordingly, the engine hanger boss can be set to a comparatively high position, and the minimum load clearance of the crankcase can be set even higher.

Other objects, aspects and salient features of the invention will be apparent from the following detailed description which, taken together with the annexed drawings, describes a present embodiment of the invention.

DETAILED DESCRIPTION OF THE INVENTION

In the following, an embodiment of the present invention is described in connection with a working example of the present invention shown in the accompanying drawings.

Figure 1:
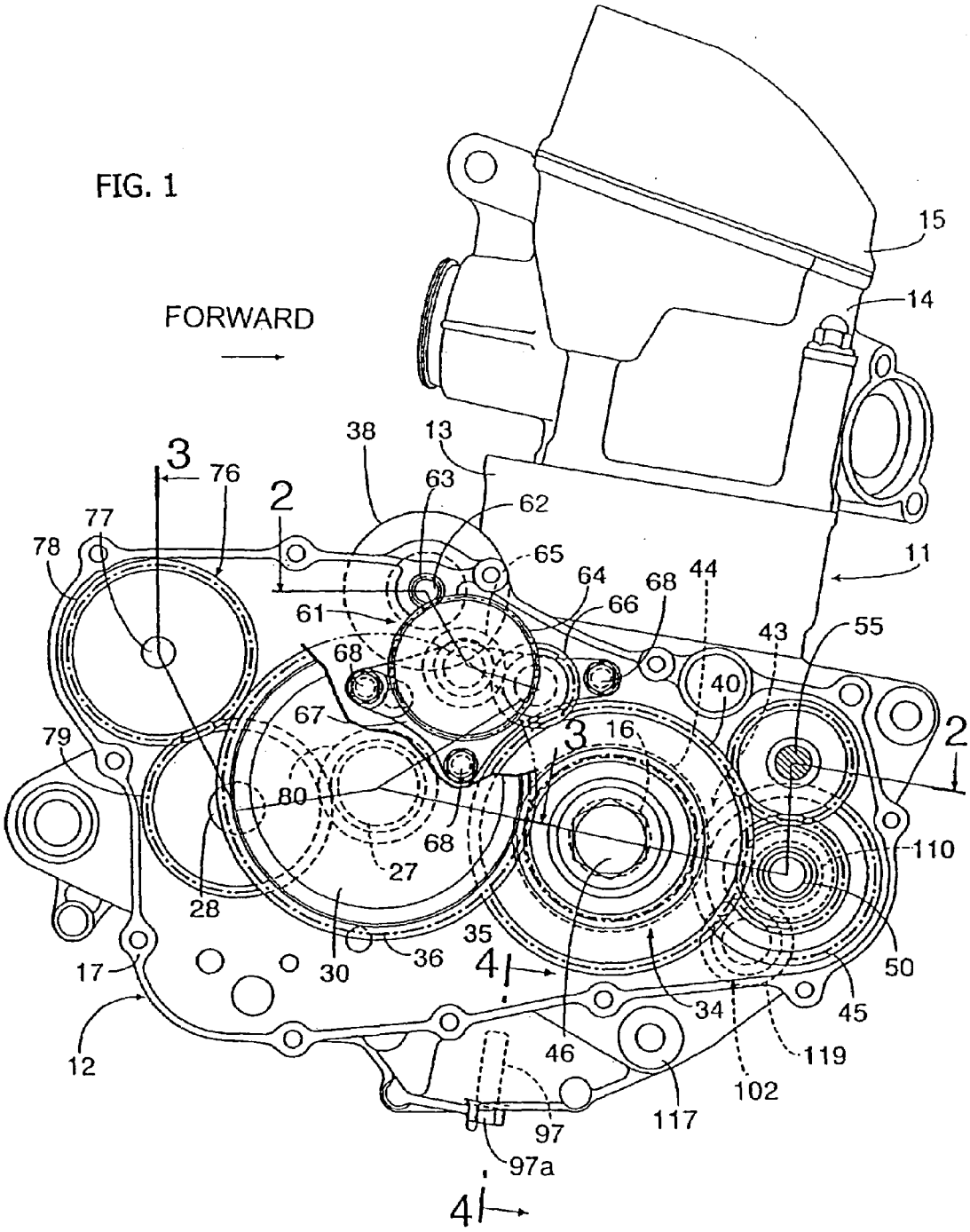
FIG. 1 is a vertical sectional side elevational view of an engine and is a sectional view taken along line 1—1 of FIG. 2.

Referring first to FIG. 1, the engine is a single-cylinder 4-cycle engine incorporated in a vehicle such as a motorcycle. An engine body 11 includes a crankcase 12, a cylinder block 13 coupled to the crankcase 12, a cylinder head 14 coupled to the cylinder block 13, and a head cover 15 coupled to the cylinder head 14.

Figure 2:
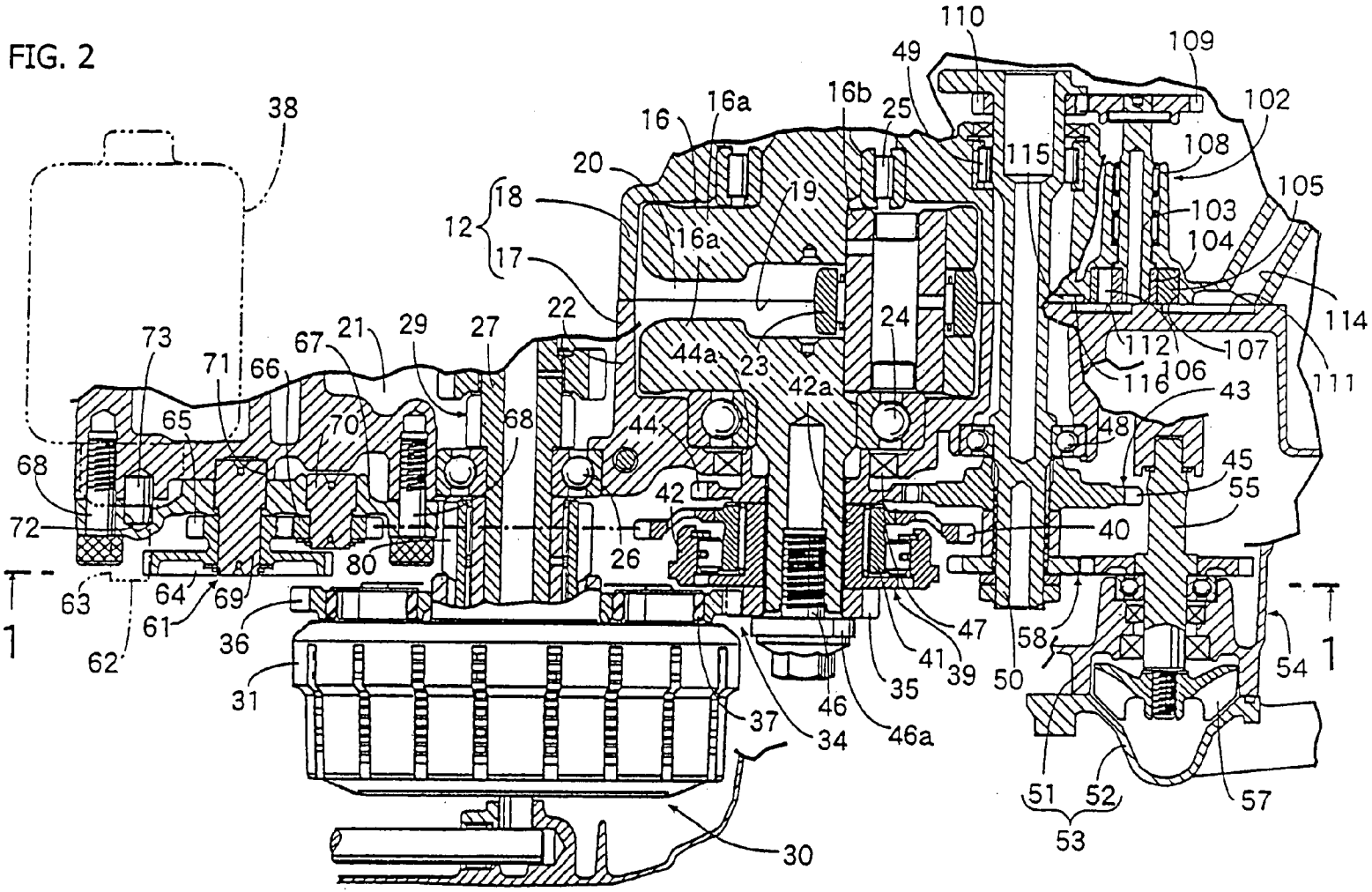
FIG. 2 is a sectional view taken along line 2—2 of FIG. 1.

Referring also to FIG. 2, the crankcase 12 supports a crankshaft 16 for rotation thereon and includes a right case half 17 disposed on the right side when the crankcase 12 is incorporated in the motorcycle and a left case half 18 disposed on the left side when the crankcase 12 is incorporated in the motorcycle. The right case half 17 and the left case half 18 are coupled to each other along a mating plane 19 extending along a plane perpendicular to an axial line of the crankshaft 16. The two case halves 17 and 18 are formed from aluminum alloy. Also, a crank chamber 20 for accommodating a major portion of the crankshaft 16 therein and a mission chamber 21 in which a transmission of the normally meshing type is accommodated are formed in an isolated relationship from each other by a partition wall 22 in the crankcase 12.

The crankshaft 16 includes a pair of crank webs 16*a*, 16*a* and a crank pin 16*b* which interconnects the two crank webs 16*a*, 16*a*, and a major portion of the crankshaft 16 is accommodated in the crank chamber 20. A connecting rod 23 connects to a piston (not shown) fitted for sliding movement in the cylinder block 13 and is connected at a major end portion thereof to the crank pin 16*b*.

One end portion of the crankshaft 16 extends for rotation through the right case half 17 while the other end portion of the crankshaft 16 extends for rotation through the left case half 18. A ball bearing 24 is interposed between the right case half 17 and the crankshaft 16 while a roller bearing 25 is interposed between the left case half 18 and the crankshaft 16.

Figure 3:
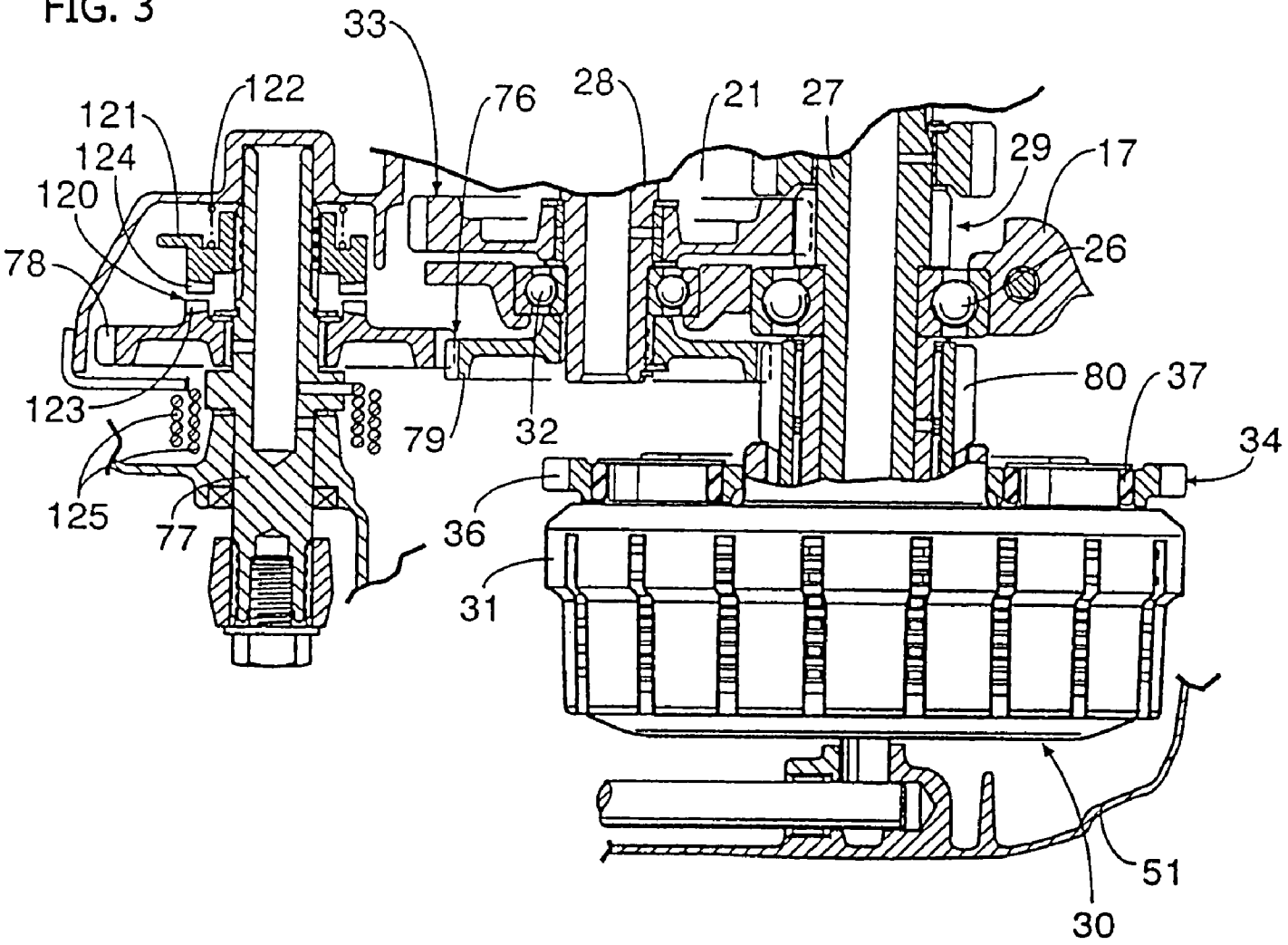
FIG. 3 is a sectional view taken along line 3—3 of FIG. 1.

Referring also to FIG. 3, the transmission mentioned hereinabove includes a main shaft 27 supported for rotation on the right and left case halves 17 and 18 through ball bearings 26, etc., such that it has an axial line parallel to the crankshaft 16, and a countershaft 28 supported for rotation on the two case halves 17 and 18 through ball bearings 32, such that it has an axial line parallel to the main shaft 27. A driving gear group 29 having a plurality of transmission stages is mounted on the main shaft 27 while a driven gear group 33 corresponding to the driving gear group 29 is mounted on the countershaft 28. Thus, output power of the engine is transmitted to the countershaft 28 after the speed thereof is changed among the plural stages through selective establishment of mutually corresponding gears of the driving gear group 29 and the driven gear group 33.

One end portion of the main shaft 27 projects from the right case half 17, and a speed changeover clutch 30 for changing over connection/disconnection of power between the crankshaft 16 and the main shaft 27 is mounted on the one end portion of the main shaft 27. The speed changeover clutch 30 includes an input member 31 supported for relative rotation on the main shaft 27.

A power transmitting gear train 34 is provided between the input member 31 of the speed changeover clutch 30 and the crankshaft 16. The power transmitting gear train 34 includes a first driving gear 35 secured to the one end portion of the crankshaft 16 and a clutch gear 36 for meshing with the first driving gear 35. The clutch gear 36 is connected to the input member 31 through a damper 37 and rotates together with the input member 31.

A starter motor 38 is attached to the right case half 17 above the main shaft 27 such that it has an axial line of rotation parallel to the main shaft 27. A starter one-way clutch 39 is mounted at the one end portion of the crankshaft 16 such that it is interposed between the starter motor 38 and the crankshaft 16 and disposed between the driving gear group 29 and the clutch gear 36 along the axial line direction of the main shaft 27.

The starter one-way clutch 39 includes a clutch inner member 41 to which a free wheel gear 40 is attached. Power from the starter motor 38 is input to the free wheel gear 40. The clutch 39 also includes a clutch outer member 42 mounted against relative rotation on the crankshaft 16 and having an inner circumferential boss portion 42*a* for supporting the clutch inner member 41 for relative rotation thereon. The inner circumferential boss portion 42*a* is sandwiched between the first driving gear 35 and a second driving gear 44 secured to the crankshaft 16 and forming part of an auxiliary machine driving power transmission gear train 43.

The first driving gear 35, the inner circumferential boss portion 42*a* of the clutch outer member 42 and the second driving gear 44 are mounted in a mutually contacting relationship against relative rotation on the crankshaft 16 by spline fitting or the like. A tubular portion 44*a* is provided in a projecting manner integrally on the second driving gear 44 and contacts with an outer face of an inner race of the ball bearing 24 interposed between the crankshaft 16 and the crankcase 12 inwardly of the second driving gear 44 in the axial direction. A bolt 46 is screwed coaxially at the one end portion of the crankshaft 16 and has an increased diameter head portion 46*a* which contacts and engages with an outer end of the first driving gear 35.

Thus, the starter one-way clutch 39 and the second driving gear 44 are disposed in parallel to each other between the first driving gear 35 and the ball bearing 24, and an annular oil seal 47 is interposed between the tubular portion 44*a* and the right case half 17.

The auxiliary machine driving power transmission gear train 43 is provided between the crankshaft 16 and a balancer shaft 50. The shaft 50 is supported for rotation on the right case half 17 and the left case half 18 forwardly of the crankshaft 16 through a ball bearing 48 and a roller bearing 49. The auxiliary machine driving power transmission gear train 43 includes a second driving gear 44 secured to the crankshaft 16 and a first driven gear 45 secured to one end portion of the balancer shaft 50 for meshing with the second driving gear 44.

A water pump 54 is disposed above the balancer shaft 50. The pump 54 includes a pump housing 53 composed of a right cover 51 coupled to the right case half 17 from the outer side and a pump cover 52 fastened to an outer face of the right cover 51. The water pump 54 has a pump shaft 55 parallel to the balancer shaft 50.

The pump shaft 55 extends liquid-tight for rotation through the right cover 51 of the pump housing 53, and a rotary vane 56 is securely mounted coaxially at one end portion of the pump shaft 55 which projects into the pump housing 53. The pump shaft 55 is supported at the other end portion thereof for rotation by the right case half 17.

A transmission gear train 58 is provided between the one end portion of the balancer shaft 50 and the pump shaft 55 such that power transmitted from the crankshaft 16 to the balancer shaft 50 through the auxiliary machine driving power transmission gear train 43 is transmitted to the pump shaft 55 through the transmission gear train 58.

Incidentally, a starting power transmission gear train 61 is provided between the starter motor 38 and the one end portion of the crankshaft 16. The starting power transmission gear train 61 includes a third driving gear 63 secured to an output power shaft 62 of the starter motor 38, a reduction gear 64 for meshing with the third driving gear 63, a first idle gear 65 integral with the reduction gear 64, a second idle gear 66 for meshing with the first idle gear 65, and the free wheel gear 40 securely mounted coaxially on the clutch inner member 41 of the starter one-way clutch 39 for meshing with the second idle gear 66.

Also, part of the starting power transmission gear train 61 is covered from the outer side with the speed changeover clutch 30, and the plural gears 64, 65 and 66 except the free wheel gear 40 and the third driving gear 63 on the one end portion side of the crankshaft 16 from among the gears 63 to 66 which form the starting power transmission gear train 61 are supported in a cantilever fashion on the crankcase 12.

A holder plate 67 made of a steel material is attached to an outer face of the right case half 17 of the crankcase 12 by means of a plurality of, for example, three, screw members 68, 68, etc. A plurality of, two in the present working example, support shafts 69 and 70 are secured on one end side thereof to the holder plate 67 by force fitting or the like. The reduction gear 64 and the first idle gear 65 are supported for rotation on the other end side of the support shaft 69 while the second idle gear 66 is supported for rotation on the other end side of the other support shaft 70.

Also, one end of the support shaft 69 which is nearest to the third driving gear 63 from among the plural support shafts 69 and 70 projects from the holder plate 67 toward the crankcase 12 side, and the one end of the support shaft 69 is fitted in a positioning recess 71 provided on the right case half 17 of the crankcase 12. Another positioning recess 72 is provided on the holder plate 67 such that it is open to the right case half 17 side, and a knock pin 73 is implanted on the right case half 17 and fitted in the positioning recess 72.

Starting operation force according to a kicking operation can be inputted to the clutch gear 36 through a kick-start gear train 76. The kick-start gear train 76 includes a fourth driving gear 78 mounted on a kick shaft 77 supported for rotation on the crankcase 12, a third idle gear 79 secured to the countershaft 28 and meshing with the fourth driving gear 78, and a second driven gear 80 supported for relative rotation on the main shaft 27 and meshing with the third idle gear 79. The input member 31 of the speed changeover clutch 30 is mounted against relative rotation on the second driven gear 80.

Also, the kick-start gear train 76 is disposed between the driving gear group 29 and the clutch gear 36 along the direction of the axial line of the main shaft 27.

The fourth driving gear 78 is supported for rotation but against relative movement in the axial direction on the kick shaft 77, and a one-way clutch mechanism 120 for connecting the kick shaft 77 and the fourth driving gear 78 to each other upon forward rotation of the kick shaft 77 is provided between the kick shaft 77 and the fourth driving gear 78.

The one-way clutch mechanism 120 includes a clutch body 121 supported for relative movement in the axial direction but against relative rotation on the kick shaft 77, and a friction spring 122 for applying frictional resistance to rotation of the clutch body 121. Ratchet teeth 123 and 124 are formed on opposing faces of the fourth driving gear 78 and the clutch body 121 such that, when they mesh with each other, they transmit only forward rotation of the clutch body 121, that is, the kick shaft 77, to the fourth driving gear 78.

A pair of kick return springs 125, 125 each in the form of a torsion coil spring are provided between the right case half 17 and the kick shaft 77 such that they are disposed dually on the inner side and the outer side. The kick shaft 77 is resiliently biased to the returning side by the kick return springs 125, 125.

Figure 4:
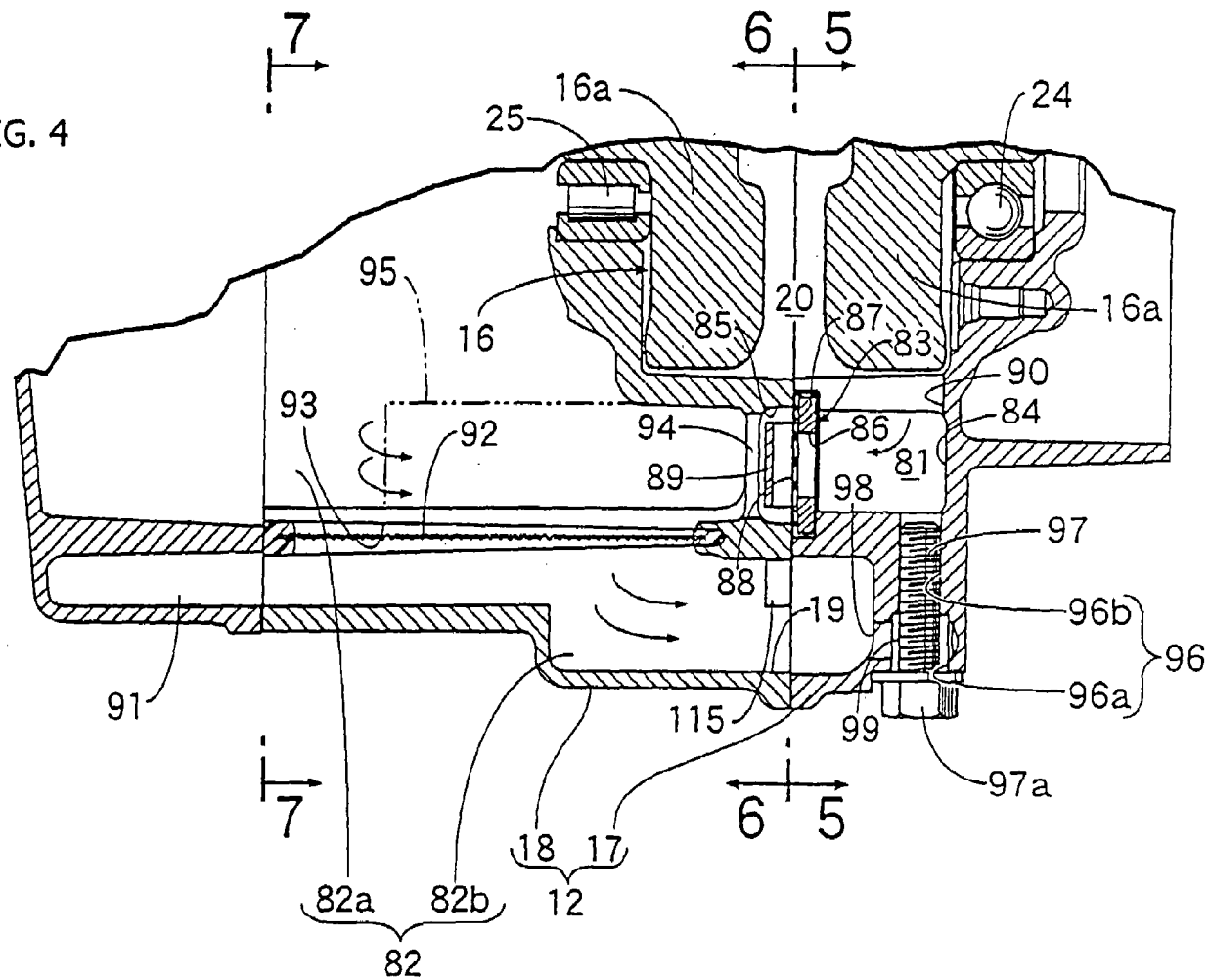
FIG. 4 is a sectional view taken along line 4—4 of FIG. 1.
Figure 5:
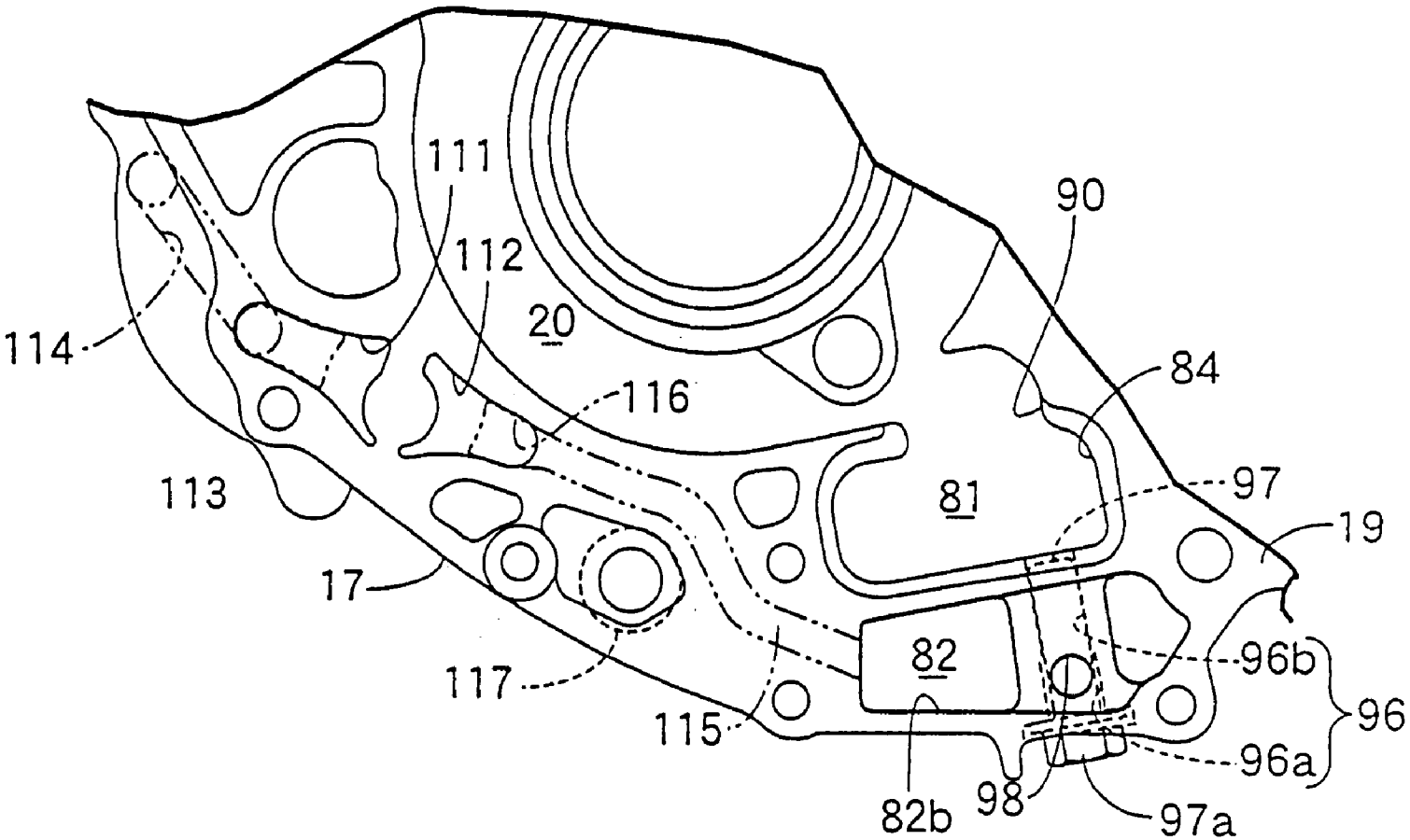
FIG. 5 is a view of part of a right case half as viewed in the direction indicated by an arrow mark along line 5—5 of FIG. 4.
Figure 6:
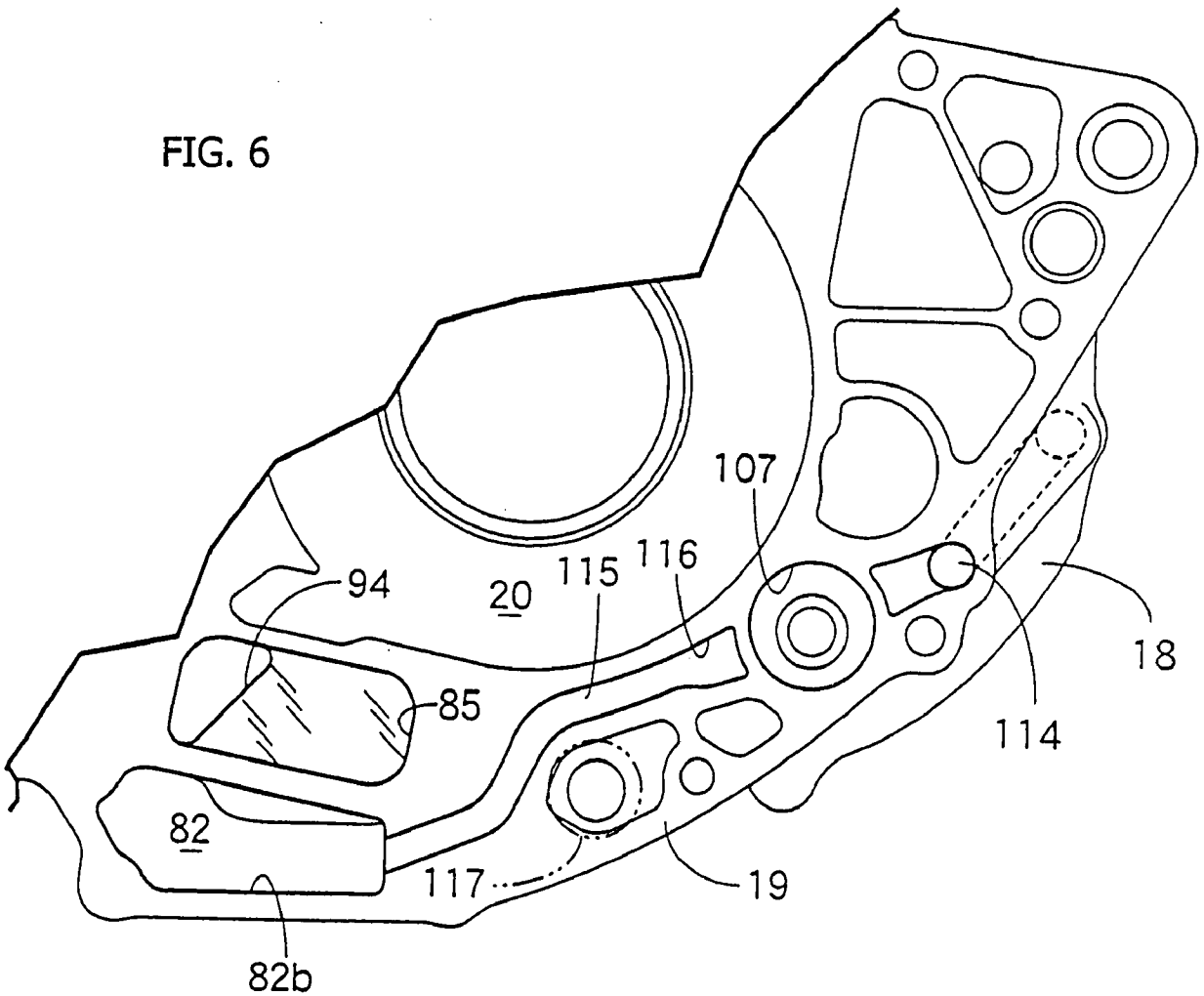
FIG. 6 is a view of a left case half as viewed in the direction indicated by an arrow mark along line 6—6 of FIG. 4.

Referring to FIGS. 4 to 6, a first oil reservoir 81 communicating with a lower portion of the crank chamber 20 and a second oil reservoir 82 are formed at a lower portion of the crankcase 12. A reed valve 83, which opens and closes in response to a pressure variation in the crank chamber 20, is interposed between the first oil reservoir 81 and the second oil reservoir 82.

A right side recess 84 and a left side recess 85 are provided at lower portions of the right case half 17 and the left case half 18 such that they are opposed to each other across the mating plane 19. The reed valve 83 is sandwiched between the open ends of the two recesses 84 and 85 when the right case half 17 and the left case half 18 are coupled to each other.

The reed valve 83 includes a valve plate 87 having a valve hole 86, a reed 88 attached to the valve plate 87 for opening and closing the valve hole 86, and a support plate 89 attached to the valve plate 87 in such a manner as to hold the valve opening position of the reed 88. An outer circumferential portion of the valve plate 87 is sandwiched between the open ends of the two recesses 84 and 85 such that the reed 88 and the support plate 89 are disposed on the left side recess 85 side.

The first oil reservoir 81 is formed on the right case half 17 side between the right side recess 84 and the reed valve 83, and a communicating hole 90 is provided in the right case half 17 such that it allows communication between a lower portion of the crank chamber 20 and the first oil reservoir 81.

Figure 7:
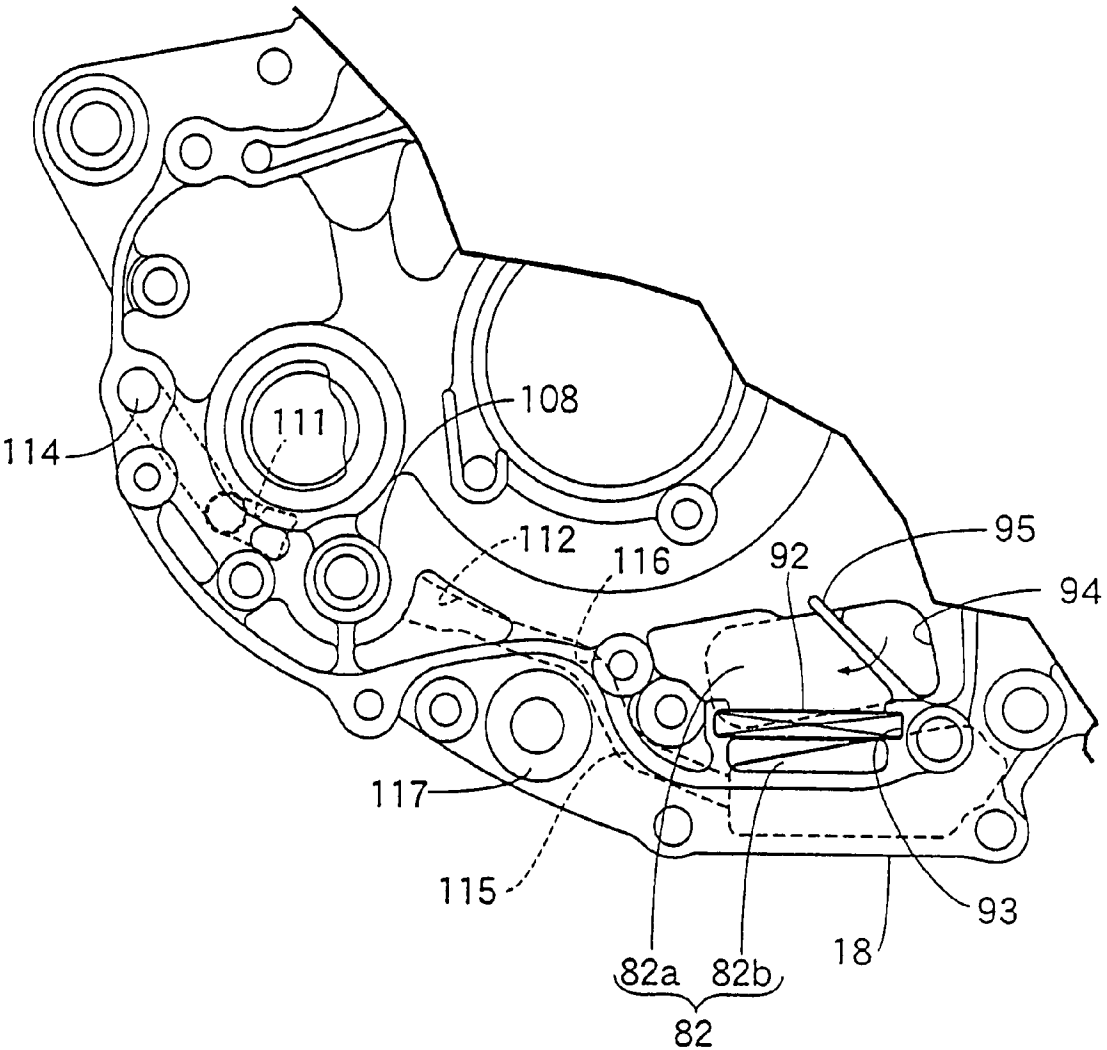
FIG. 7 is a view of the left case half as viewed in the direction indicated by an arrow mark along line 7—7 of FIG. 4.

Referring also to FIG. 7, the second oil reservoir 82 includes an upper oil chamber 82*a* formed between lower end portions of the left case half 18 and a left cover 91 coupled to the left case half 18 from the outer side. The second oil reservoir 82 also includes a lower oil chamber 82*b* formed across the mating plane 19 at lower portions of the right case half 17, the left case half 18 and the left cover 91. The upper oil chamber 82*a* is open to the atmospheric air through a breather path not shown so that the pressure in the second oil reservoir 82 is equal to the atmospheric pressure. A mounting groove 93 for mounting a filter 92 for isolating the upper oil chamber 82*a* and the lower oil chamber 82*b* from each other is provided on the right case half 18 such that it is open to the left cover 91 side, and when the left cover 91 is coupled to the left case half 18, removal of the filter 92 from the mounting groove 93 is blocked.

A guide hole 94 is provided at the closed end of the left side recess 85 of the left case half 18 such that it introduces oil flowing out from the first oil reservoir 81 when the reed valve 83 opens to the upper oil chamber 82*a* side of the second oil reservoir 82. Meanwhile, a guide wall 95 is provided integrally on the left case half 18 such that it guides oil from the guide hole 94 so as to flow to the left cover 91 side in order to filter the oil discharged from the guide hole 94 to the upper oil chamber 82*a* side over a substantially overall area of the filter 92.

A lowermost portion of the lower oil chamber 82*b* of the second oil reservoir 82 is disposed below the first oil reservoir 81, and a drain hole 96 is open to a bottom portion of the first oil reservoir 81 and extends upwardly and downwardly. The drain hole 96 is provided at a lower portion of the right case half 17 such that it is open at an intermediate portion thereof to the lowermost portion of the lower oil chamber 82*b* and open at a lower end thereof to the bottom face of the right case half 17 of the crankcase 12.

A drain bolt 97 is inserted in the drain hole 96 and screwed into the right case half 17 from below the crankcase 12. The lowermost portions of the first oil reservoir 81 and the lower oil chamber 82*b* are disconnected from each other and the second oil reservoir 82 is disconnected from the outside of the crankcase 12 by the drain bolt 97.

The drain hole 96 includes an insertion hole portion 96*a* which is open at a lower end thereof to the bottom face of the right case half 17. The drain hole 96 also includes and a threaded hole portion 96*b* formed with a smaller diameter than the insertion hole portion 96*a* and coaxially connecting to the insertion hole portion 96*a*. The threaded hole portion 96*b* is open at an upper end thereof to the first oil reservoir 81. A communicating hole 98 is provided in the right case half 17 such that it communicates at one end thereof to the lowermost portion of the lower oil chamber 82*b* of the second oil reservoir 82 and is open at the other end thereof to an inner face of an intermediate portion of the insertion hole portion 96*a*. The drain bolt 97 cooperates with an inner face of the insertion hole portion 96*a* to form therebetween an annular chamber 99 which communicates with the communicating hole 98. The drain bolt 97 is screwed in the threaded hole portion 96*b* while an increased diameter head portion 97*a* thereof contacts and engages liquid-tight with the bottom portion of the right case half 17 of the crankcase 12.

Incidentally, oil accumulating at the lowermost portion of the second oil reservoir 82 is pumped up by an oil pump 102. The oil pump 102 is located on the crankcase 12 such that, in a state wherein the engine is incorporated in a vehicle, it is disposed forwardly of the crankshaft 16.

The oil pump 102 is formed as an oil pump of the trochoid type which includes an inner rotor 104 secured to an inner end of an pump shaft 103 and an outer rotor 105 held in meshing engagement with the inner rotor 104.

A pump chamber 106 accommodates the inner rotor 104 and the outer rotor 105 therein. The pump chamber 106 is formed from the right case half 17 and an accommodating recess 107. The accommodating recess 107 is provided on the left case half 18 and exposed to the mating plane 19 such that the mating plane 19 is positioned between the right case half 17 and the left case half 18.

The pump shaft 103 is supported liquid-tight and for rotation by a supporting tubular portion 108 provided on the right case half 17. A fourth driven gear 109 is secured to an outer end portion of the pump shaft 103 which projects from the supporting tubular portion 108. Meanwhile, a fifth driving gear 110 is secured to the other end portion of the balancer shaft 50. The pump shaft 103 is driven to rotate as the fifth driving gear 110 meshes with the fourth driven gear 109.

A discharge side recess 111 communicating with the pump chamber 106 and a suction side recess 112 communicating with the pump chamber 106 are provided at a portion of the right case half 17 exposed to the mating plane 19. The recesses 111 and 112 are so provided such that a bearing portion 113 for receiving an inner end portion of the pump shaft 103 is formed therebetween.

Meanwhile, an oil discharging path 114 is provided in the left case half 18 such that it is open at one end thereof to the mating plane 19. The oil discharging path 114 communicates with the discharge side recess 111 such that oil is supplied therethrough to portions of the engine to be lubricated.

The suction side recess 112 and the lowermost portion of the second oil reservoir 82 are connected to each other by an oil suction path 115. A path groove 116 is provided on at least one of the two case halves 17 and 18, in the present working example, on the left case half 18. The path groove 116 forms the oil suction path 115 between the case halves 17 and 18 across the mating plane 19.

The oil suction path 115 is disposed around the crankshaft 16. The oil suction path 115 communicates at a lower portion of a front wall of the lowermost portion thereof with the lowermost portion of the second oil reservoir 82.

Incidentally, an engine hanger boss 117 for mounting the engine on a vehicle is provided on the crankcase 12 below the crankshaft 16. The oil suction path 115 is disposed such that it passes between the crankshaft 16 and the engine hanger boss 117.

Now, operation of the present working example is described. The second oil reservoir 82 is formed across the mating plane 19 at a lower portion of the crankcase 12 below the crankshaft 16. The pump chamber 106 of the oil pump 102 for sucking oil from the lowermost portion of the second oil reservoir 82 is formed between the right and left case halves 17 and 18 across the mating plane 19. Further, the oil suction path 115 for interconnecting the lowermost portions of the oil pump 102 and the second oil reservoir 82 is formed from the path groove 116. The path groove 116 is provided in at least one of the two case halves 17 and 18 (in the present working example, in the left case half 18) between the case halves 17 and 18 across the mating plane 19.

In particular, if the case halves 17 and 18 are coupled to each other along the mating plane 19 to form the crankcase 12, then the oil suction path 115 for introducing oil of the second oil reservoir 82 to the oil pump 102 is formed. Thus, when compared with an alternative arrangement which uses an oil pipe or the like, increase of the width of the engine caused by projection of the oil path in the leftward and rightward directions is prevented while the bank angle is assured. The number of parts can also be reduced and improvement of the assembling facility can be achieved.

Further, the oil pump 102 is disposed forwardly of the crankshaft 16 while it is incorporated in a vehicle. In addition, the oil suction path 115 disposed around the crankshaft 16 communicates with the second oil reservoir 82 at the lower portion of the front wall at the lowermost portion of the second oil reservoir 82. Therefore, the oil suction path 115 can be disposed in the proximity of the crankshaft 16 to make it possible to set the lowest road clearance of the crankcase 12 comparatively high while the capacity of the second oil reservoir 82 can be set comparatively great.

Further, the engine hanger boss 117 is provided on the crankcase 12 below the crankshaft 16. The oil suction path 115 is disposed such that it passes between the crankshaft 16 and the engine hanger boss 117. Since the internal pressure of the oil suction path 115 is low and the seal width of the oil suction path 115 on the mating plane 19 can be set comparatively small, the engine hanger boss 117 can be set to a comparatively high position, and the lowest road clearance of the crankcase 12 can be set even higher.

Incidentally, the first oil reservoir 81 communicating with a lower portion of the crank chamber 20 and the second oil reservoir 82 are formed in the crankcase 12 such that the reed valve 83 which opens and closes in response to a variation of the pressure in the crank chamber 20 is interposed between the first oil reservoir 81 and the second oil reservoir 82. More particularly, the first and second oil reservoirs 81 and 82 are formed in the crankcase 12 such that the lowermost portion of the second oil reservoir 82 is disposed below the first oil reservoir 81. Further, the drain hole 96 is formed at a lower portion of the right case half 17 of the crankcase 12 such that it extends upwardly and downwardly with an upper end thereof opened to the bottom portion of the first oil reservoir 81 while it is open at an intermediate portion thereof to the lowermost portion of the second oil reservoir 82 and open at a lower end thereof to the bottom face of the crankcase 12. Further, the drain bolt 97 is inserted in the drain hole 96 and screwed in the right case half 17 from below the crankcase 12 such that it disconnects the lowermost portions of the first oil reservoir 81 and the second oil reservoir 82 from each other and disconnects the second oil reservoir 82 from the outside of the crankcase 12.

Accordingly, if the single drain bolt 97 is loosened and removed from the crankcase 12, then oil in both of the first and second oil reservoirs 81 and 82 can be discharged to the outside of the crankcase 12, but if the drain bolt 97 is screwed into the right case half 17 and tightened, then both of the first and second oil reservoirs 81 and 82 can be disconnected from the outside of the crankcase 12. Consequently, in discharging of oil from the first and second oil reservoirs 81 and 82, reduction of the number of parts and improvement of the maintenance facility can be achieved.

Also, the drain hole 96 is composed of the insertion hole portion 96*a* and the threaded hole portion 96*b*. The insertion hole portion 96*a* is open at a lower end thereof to the bottom face of the right case half 17. The threaded hole portion 96*b* is formed with a smaller diameter than the insertion hole portion 96*a* and coaxially connecting to the insertion hole portion 96*a*. The threaded hole portion 96*b* is open at an upper end thereof to the first oil reservoir 81. Meanwhile, the communicating hole 98 is provided in the right case half 17 such that it communicates at one end thereof to the lowermost portion of the second oil reservoir 82. The communicating hole 98 is open at the other end thereof to the inner face of an intermediate portion of the insertion hole portion 96*a*. Further, the drain bolt 97 is screwed in the threaded hole portion 96*b* while the increased diameter head portion 97*a* thereof contacts and engages liquid-tight with the bottom portion of the left case half 18. The drain bolt 97 cooperates with the inner face of the insertion hole portion 96*a* to form the annular chamber 99 therebetween. The annular chamber 99 communicates with the communicating hole 98.

According to such a structure of the drain hole 96 as described above, while a comparatively great length is assured for the threaded hole portion 96*b* necessary for tightening the drain bolt 97 firmly to the crankcase 12, the lowermost portion of the second oil reservoir 82 can be communicated at a position thereof as low as possible with the drain hole 96. Consequently, the remaining oil amount in the first oil reservoir 81 can be reduced to the utmost and also the remaining oil amount in the second oil reservoir 82 can be reduced to the utmost. Further, oil running from between the drain bolt 97 and the threaded hole portion 96*b* to the insertion hole portion 96*a* side by a pressure variation in the first oil reservoir 81 is introduced to the second oil reservoir 82 side. Thus, running of oil to the outside of the crankcase 12 can be prevented, and consequently, a synergetic effect with the maintenance facility in discharging of remaining oil from the first and second oil reservoirs 81 and 82 can be anticipated.

Further, the main shaft 27 is supported for rotation on the crankcase 12 such that it has an axial line parallel to the crankshaft 16. The main shaft 27 has the driving gear group 29 of a plurality of transmission stages mounted thereon. The speed changeover clutch 30 for changing over connection/disconnection of power between the crankshaft 16 and the main shaft 27 is mounted at the one end portion of the main shaft 27. Further, the power transmitting gear train 34 including the clutch gear 36, which rotates together with the input member 31 of the speed changeover clutch 30, is provided between the one end portion of the crankshaft 16 and the input member 31. The kick-start gear train 76 which can input starting operation force according to a kicking operation to the clutch gear 36 is disposed between the driving gear group 29 and the clutch gear 36 along the direction of the axial line of the main shaft 27. Furthermore, the starter one-way clutch 39 interposed between the starter motor 38 and the crankshaft 16 is mounted on the crankshaft 16 between the driving gear group 29 and the clutch gear 36 along the direction of the axial line of the main shaft 27.

According to such a structure as just described, since the starter one-way clutch 39 is mounted on the crankshaft 16, the power transmission load to be borne by the starter one-way clutch 39 can be made comparatively low. Consequently, miniaturization of the starter one-way clutch 39 and hence of the engine can be anticipated. Also, the starter one-way clutch 39 and the kick-start gear train 76 are disposed between the driving gear group 29 and the clutch gear 36 along the direction of the axial line of the main shaft 27. Therefore, the kick-start gear train 76 can be disposed effectively in a dead space between the driving gear group 29 and the clutch gear 36 which is produced by arrangement of the starter one-way clutch 39, when starting of the engine by a kicking operation is desired in addition to starting of the engine by the starter motor 38. Thus, the engine can be prevented from having an increased scale also by the arrangement of the kick-start gear train 76.

Further, the first driving gear 35 which forms part of the power transmitting gear train 34 is secured to the one end portion of the crankshaft 16 which projects from the crankcase 12 while the ball bearing 24 is interposed between the crankshaft 16 and the right case half 17 of the crankcase 12. The starter one-way clutch 39 and the second driving gear 44 which is secured to the crankshaft 16 and forms part of the auxiliary machine driving power transmission gear train 43 are disposed in parallel to each other between the first driving gear 35 and the ball bearing 24. Consequently, the space in which the kick-start gear train 76 is disposed can be utilized effectively to hold the auxiliary machine driving power transmission gear train 43, and this can contribute to miniaturization of the engine.

The starter one-way clutch 39 includes the clutch inner member 41, to which power from the starter motor 38 is input, and the clutch outer member 42, mounted against relative rotation on the crankshaft 16. The clutch outer member 42 has the inner circumferential boss portion 42*a* for supporting the clutch inner member 41 for relative rotation. The inner circumferential boss portion 42*a* is sandwiched between the first driving gear 35 and the second driving gear 44.

Accordingly, a play of the starter one-way clutch 39 in a direction along the axial direction of the crankshaft 16 can be suppressed without using any part for exclusive use. Improvement in durability of the starter one-way clutch 39 and reduction of noise can be achieved while increase of the number of parts is prevented.

Further, the first driving gear 35, the inner circumferential boss portion 42*a* of the clutch outer member 42 and the second driving gear 44 are mounted in a mutually contacting relationship against relative rotation on the crankshaft 16. The second driving gear 44 has the tubular portion 44*a* provided integrally thereon such that it contacts with the outer face of the inner race of the ball bearing 24 interposed between the crankshaft 16 and the crankcase 12 inwardly of the second driving gear 44 in the axial direction. Further, the bolt 46 having the increased diameter head portion 46*a* for contacting and engaging with the outer end of the first driving gear 35 is screwed coaxially with the one end portion of the crankshaft 16.

Accordingly, the first driving gear 35, clutch outer member 42 and second driving gear 44 are secured to the crankshaft 16 by the simple structure. The structure eliminates any other part than the bolt 46 and is reduced in the number of parts. Also, the first driving gear 35, clutch outer member 42 and second driving gear 44 are prevented from being inclined with respect to the axial line of the crankshaft 16. Consequently, further improvement in durability of the starter one-way clutch 39 and further reduction of noise can be achieved.

Incidentally, the starter motor 38 is attached to the right case half 17 of the crankcase 12. Part of the starting power transmission gear train 61 provided between the starter motor 38 and the one end portion of the crankshaft 16 is covered from the outer side with the speed changeover clutch 30 connected for interlocking operation to the crankshaft 16. Further, the plural gears 64 to 66 from among the gears 63, 64, 65, 66 and 40 which form the starting power transmission gear train 61 except the free wheel gear 40 on the one end portion side of the crankshaft 16 and the third driving gear 63 secured to the output power shaft 62 of the starter motor 38 are supported in a cantilever fashion on the crankcase 12. Consequently, the speed changeover clutch 30 can be disposed rather near to the crankcase 12 in the direction along the axial line of the crankshaft 16. This realizes miniaturization of the engine in the direction along the axial line of the crankshaft 16.

Also, the plural (two in the present working example) support shafts 69 and 70 are secured on one end side thereof to the holder plate 67 attached to the right case half 17 of the crankcase 12. The plural gears 64 to 66 from among the gears 63 to 66 and 40 which form the starting power transmission gear train 61 except the free wheel gear 40 and the third driving gear 63 are supported for rotation on the other end side of the support shafts 69 and 70. Consequently, the holder plate 67 to which the plural gears 64 to 66 which form part of the starting power transmission gear train 61 are assembled can be attached to the crankcase 12. Therefore, ease of assembly is improved. Also, while the crankcase 12 is made of aluminum alloy, the holder plate 67 is made of a steel material. Consequently, the load to the right case half 17 at portions at which the gears 64 to 66 are supported can be reduced, and the holder plate 67 can also be formed with a comparatively small thickness.

Further, the one end of the support shaft 69 which is nearest to the third driving gear 63 from among the plural support shafts 69 and 70 described hereinabove projects to the right case half 17 side from the holder plate 67 and is fitted in the positioning recess 71 of the right case half 17. Therefore, the support shaft 69 can be utilized as a knock pin. Consequently, ease of assembly of the holder plate 67 to the crankcase 12 can be improved while reducing the number of parts. Also, since the support shaft 69 of the reduction gear 64 which has a high rotational speed is supported on the crankcase 12 to raise the supporting rigidity, improved durability can be achieved and also reduced meshing noise can be achieved.

While a working example of the present invention has been described, the present invention is not limited to the working example described above but can be modified in various manners without departing from the spirit and scope of the present invention as set forth in the claims.

Having thus described the invention, what is claimed is:

1. A lubricating structure for an engine wherein a crankcase for supporting a crankshaft for rotation thereon is formed from a pair of case halves coupled to each other along a mating plane extending along a plane perpendicular to an axial line of said crankshaft, the lubricating structure comprising: an oil reservoir formed at a lower portion of said crankcase below said crankshaft in such a manner as to extend across the mating plane; a pump chamber of an oil pump which sucks oil from said oil reservoir and is formed between said two case halves across the mating plane; and a path groove which forms an oil suction path for interconnecting said oil pump and said oil reservoir between said two case halves which form the mating plane therebetween, the path groove being provided in at least one of said two case halves.

2. A lubricating structure for an engine according to claim 1, wherein when said oil pump is mounted on a vehicle and disposed forwardly of said crankshaft, said oil suction path is disposed around said crankshaft and communicates with said oil reservoir at a lower portion of a front wall of said oil reservoir.

3. A lubricating structure for an engine according to claim 1, wherein an engine hanger boss is provided on said crankcase below said crankshaft, and said oil suction path is disposed so as to pass between said crankshaft and said engine hanger boss.

4. A lubricating structure for an engine according to claim 2, wherein an engine hanger boss is provided on said crankcase below said crankshaft, and said oil suction path is disposed so as to pass between said crankshaft and said engine hanger boss.

5. A lubricating structure for an engine comprising:

a crankcase for supporting a crankshaft for rotation thereon, said crankcase being formed from a first case half and a second case half coupled to each other along a mating plane extending along a plane perpendicular to an axial line of said crankshaft;

an oil reservoir formed at a lower portion of said crankcase below said crankshaft in such a manner as to extend across the mating plane;

a pump chamber of an oil pump for sucking oil from said oil reservoir and formed between said two case halves across the mating plane; and a groove formed in a body at least one of said first case half and said second case half, the groove providing an oil suction path for interconnecting said oil pump and said oil reservoir.

6. The lubricating structure for an engine of claim 5 wherein the oil reservoir comprises a first oil chamber and a second oil chamber, the first and second oil chambers being formed such that a lowermost portion of the second oil chamber is disposed below the first oil chamber, a threaded drain hole is formed at a lower portion one of the crankcase halves extending vertically such that an upper end of the drain hole opens to a bottom portion of the first oil chamber, an intermediate portion of the drain hole opens to the lowermost portion of the second oil chamber, and a lower end of the drain hole opens to the outside at a bottom face of the crankcase, when a drain bolt is screwed into in the drain hole, the drain bolt prevents the bottom portions of the first and second oil chambers from communicating with each other through the drain hole, and prevents the second oil chamber from communicating the outside of the crankcase.

7. The lubricating structure for an engine of claim 6 wherein the groove communicates with the lowermost portion of the second oil chamber.

8. The lubricating structure for an engine of claim 5 wherein the oil reservoir communicates with a lower portion of a crank chamber surrounding said crankshaft, and a reed valve is provided between the oil reservoir and the second oil chamber, the reed valve opening and closing in response to variations of the pressure within the crank chamber.

9. The lubricating structure for an engine of claim 8 wherein the first case half is provided with a first recess and the second case half is provided with a second recess, and when the first and second case halves are coupled to each other the first and second recesses are positioned to oppose each other across the mating plane, and the reed valve is sandwiched between open ends of the first and second recesses.

10. The lubricating structure for an engine of claim 6 wherein the first oil chamber communicates with a lower portion of a crank chamber surrounding said crankshaft, and a reed valve is provided between the first oil chamber and the second oil chamber, the reed valve opening and closing in response to variations of the pressure within the crank chamber.

11. The lubricating structure for an engine of claim 8 wherein the first case half is provided with a first recess and the second case half is provided with a second recess, and when the first and second case halves are coupled to each other the first and second recesses are positioned to oppose each other across the mating plane, and the reed valve is sandwiched between open ends of the first and second recesses.

12. The lubricating structure for an engine of claim 5 wherein the groove is disposed adjacent the crankshaft.

13. The lubricating structure for an engine of claim 5, further comprising an engine hanger boss provided on said crankcase below said crankshaft, and said groove is disposed so as to pass between said crankshaft and said engine hanger boss.

* * * * *